United States Patent [19]

Sletten

[11] 4,145,694

[45] Mar. 20, 1979

[54] COMPACT, DIRECTIVE, BROADBAND ANTENNA SYSTEM HAVING END LOADED DIPOLES

[76] Inventor: Carlyle J. Sletten, 106 Nagog Hill Rd., Acton, Mass. 01720

[21] Appl. No.: 820,620

[22] Filed: Aug. 1, 1977

[51] Int. Cl.[2] ..... H01Q 21/00; H01Q 9/44

[52] U.S. Cl. ..... 343/727; 343/802; 343/809; 343/819; 343/876

[58] Field of Search ..... 343/726, 727, 730, 803, 343/806, 809, 817, 818, 876, 802, 819

[56] References Cited

U.S. PATENT DOCUMENTS

| | | | |
|---|---|---|---|
| 2,507,225 | 5/1950 | Scheldorf | 343/795 |
| 2,532,138 | 11/1950 | Atchison | 343/730 |
| 2,640,933 | 6/1953 | Spindler | 343/803 |
| 2,642,528 | 6/1953 | Albright | 343/822 |
| 4,038,662 | 7/1977 | Turner | 343/802 |

*Primary Examiner*—Eli Lieberman

[57] ABSTRACT

A compact, all channel television antenna system is provided for improved reception within buildings where multiple reflections or ghosting and weak signals are typical operating conditions. The high performance in this environment with a very small antenna is achieved by the antenna's directive gain and pattern nulls, good impedance matching, low acceptance of vertical polarization, band switching, and repeatable orientation of the antenna. The antenna is characterized by a miniature, symmetrically top-loaded dipole and efficient matching circuit at the lower VHF television band. The top-loading elements are reused as parasitic elements in a compact, directive array at the upper VHF channels. Similarly, in the UHF television bands bending and top loading is used to reduce the size of radiators and to provide loading for the VHF bands. A construction of UHF half loops in parallel is used with a system of reflecting and directing elements.

4 Claims, 5 Drawing Figures

COMPACT, DIRECTIVE, BROADBAND ANTENNA SYSTEM HAVING END LOADED DIPOLES

BACKGROUND OF THE INVENTION

The present invention relates generally to antennas for use in the frequency bands between 20 MHz to 1000 MHz where small and compact structures are of great utility in receiving and transmitting electromagnetic signals. More particularly, this invention applies to the problem of maximizing reception from television stations at great distances and in different locations by means of compact indoor antennas connected to the television receiver.

The problem of obtaining clear television pictures with television sets and antennas situated interior to dwellings has received considerable attention. The signals penetrating houses and apartments are attenuated and reflected causing the reception to be weak and producing a multiple of reflected signals due to reflections from within and outside of the building. These reflected signals arriving from different directions and different paths result in undesirable ghosts or multiple pictures in the video reproduction. In this indoor signal environment the television set owner typically uses "rabbit ears," an antenna consisting of variable lengths swiveled or pivoted dipole/loop elements located on top or near the television receiver (U.S. Pat. No. 3,478,361). The operator attempts to adjust the length and orientation of dipole elements in order to increase the signal strength and reduce the multiple reflection causing visible multiple pictures or ghosts on the television screen. Although other indoor television antennas exist using configurations of loops, dipoles, wires, and electrical circuits, these existing antennas are deficient in directivity and gain needed to receive desired direct signals and to discriminate against reflected and depolarized signals. Impedance matching is often done with lossy networks which attenuate signals or with circuits which are non-compensating with frequency change. Existing indoor antennas do not have accurate and repeatable means for repositioning and tuning on different channels. Further disadvantages of existing indoor TV antennas include the complexity of matching circuits, some of which need electrical power and the large physical dimensions of dipoles and loops. (U.S. Pat. Nos. 2,281,429; 2,558,487; 3,710,337; and 3,721,990.)

SUMMARY OF THE INVENTION

It is a general object of this invention to provide, among other advantages, an antenna with better signal reception and gain and a more satisfactory solution to the multiple reflection problems than other antennas currently available of comparable size and economy of construction. It is expected, also, that the techniques described herein for size miniaturization, broadband impedance matching, and multiple use of radiating elements will find other applications in receiving and transmitting radio waves outside the field of VHF and UHF television.

It is an object of the present invention to provide a compact, low cost, indoor antenna for receiving television VHF channels 2 through 13 and UHF television channels 14 through 83 with excellent signal reception.

It is also an object of this invention to reduce the adverse effects of interior multiple reflections or ghosts by providing an antenna with directive patterns and deep nulls which can be rotated in a manner to place nulls or pattern minima on unwanted signals and placing the peak of the antenna pattern on signals from desired directions.

Another object of this invention is to accept only the horizontally polarized signals transmitted by the television transmitter and to reject vertically polarized signals due to reflections.

A further object of this invention is to provide an indoor antenna which will increase the signals available to the television receiver.

A still further object of this invention is to provide an antenna with patterns and impedances separated for different channels and bands in order to maintain sharp nulls and directive patterns on all channels without contamination from signals received from portions of the antenna.

An additional object of this invention is to provide an antenna matching to the 300 ohm twin line for all TV channels and, in particular, a novel method of matching the lower frequency VHF channels 2 through 6 by means of a network of inductive coils.

Another objective of this invention is to provide a means for locating this antenna on top of the TV receiver or on other convenient furniture or structure near the TV set and to rotate the indoor antenna in order to maximize reception from selected television stations and, furthermore, to provide a readily accessible record of those best antenna headings for later reference and use.

Still another object of this invention is to provide efficient and directive reception of UHF signals with a structure about one half the size of conventional loops used for this function.

The present invention solves difficulties of prior indoor TV antennas by increasing the antenna gain by use of multiple elements suitably disposed to increase, by as much as 4 or 6 dB, the received signal power available to the television set in comparison with dipole antennas, and by matching the antenna to the 300 ohm or other transmission line impedance such that signals are not reflected and reradiated but are carried efficiently to the TV set terminals. Such matching is done with lossless components. A network of coils is used which transforms the low radiation resistance on channels 2 through 6 to the high impedance of the twin line making use of the characteristics of the antenna terminal impedance to simplify the network and channel switching. The highly capacitive reactance of the electrically short antenna becomes a functional part of the matching network with small coils added in series for channels 2, 3, 4, 5 and 6, to provide the proper net capacitive reactance needed to operate in conjunction with a fixed shunt coil to transform the impedance to 300 ohms (real). The shunt coil impedance grows in value with increasing frequency to compensate for the radiation resistance of the antenna which grows with increasing frequencies for channels 2 through 6. A means for reliably repositioning and pointing the antenna for optimum reception of a given transmitting station is provided. The physical size of the antenna is kept small by reusing the elements — first, members act as top loading to effectively increase the electrical length and radiation resistance of the antenna on channels 2 through 6; and, second, these members are used as director and reflector of a three-element yagi array on channels 7 through 13. Further, reduction in size is obtained by using half loops rather than whole loops, and by bending or curving tubing and wires used in constructing radiating elements. Antenna patterns with good front to back ratios and sharp nulls are obtained for reducing ghost signals by using antenna arraying methods and obtaining uncontaminated patterns by switching in optimum radiation structures for selected stations and by maintaining pure horizontal polarization through use of symmetry and structure.

The invention comprises a system of radiating elements composed of bent top-loaded dipoles or half circular or rectangular loops which serve to provide the proper electrical length for efficient radiation and, at the same time, certain elements act in a dual capacity as parasitic elements to increase the antenna gain and pattern directivity. Unique provisions are incorporated to improve matching and signal transfer to the television receiver at all frequencies of interest.

Briefly, the advantageous applications of the teachings, objectives and features will become apparent in the following description of this invention. In particular, the methods for miniaturization of antenna size and improvement of antenna gain, directivity and impedance matching over very wide frequency bands will have applications for the reception and transmission of electromagnetic waves for various commercial and governmental purposes.

DESCRIPTION OF PREFERRED EMBODIMENTS

Figure 1:
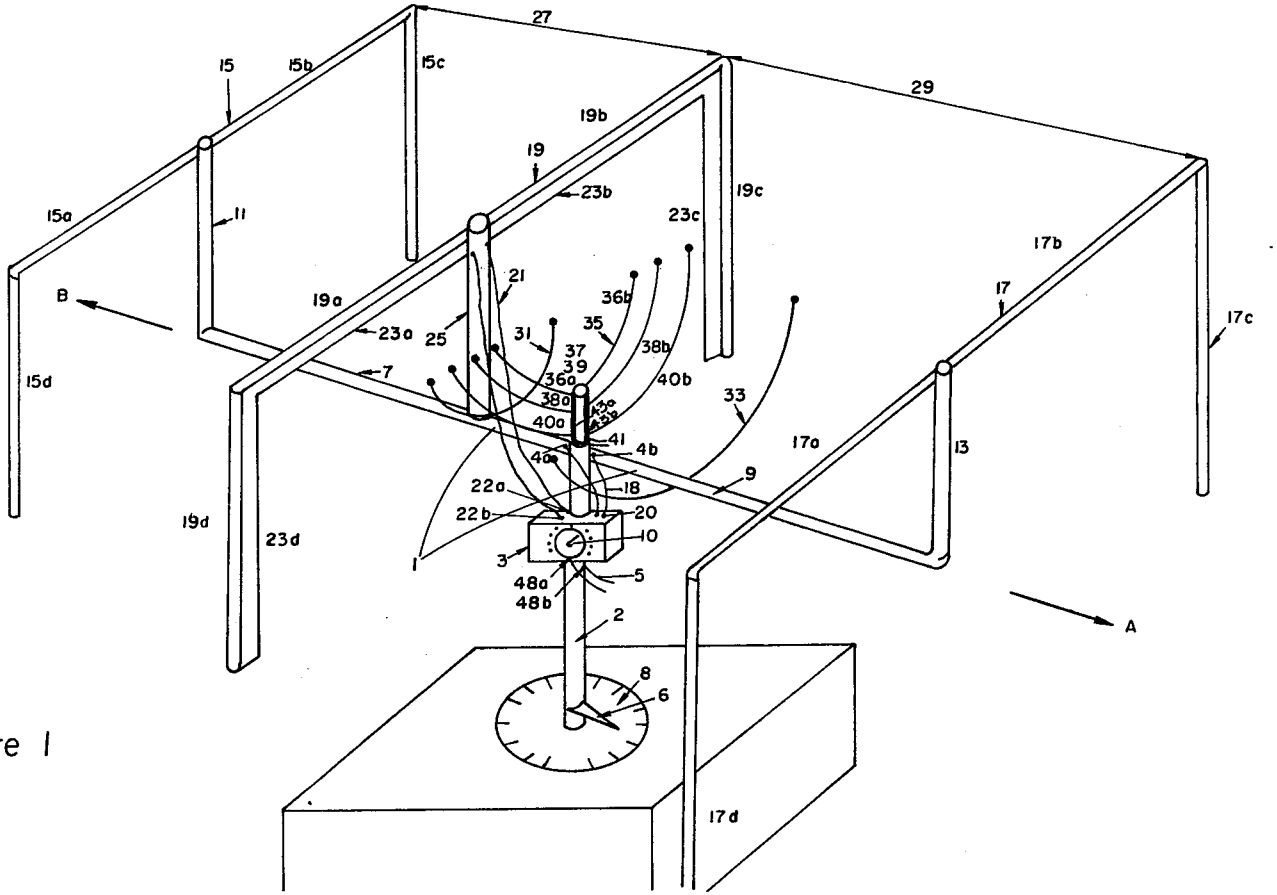
FIG. 1 is a perspective view of the antenna illustrating elements for generating antenna patterns, channel selection, matching, and rotation of antenna according to the present invention.

Referring now to FIG. 1, there is illustrated an antenna system with associated switching, matching, and mounting components. An application of this antenna to the commercial VHF and UHF frequency bands is described as an example although applications to other frequency bands and functions will be evident to those skilled in antenna technology and electromagnetic systems.

At the lower VHF TV bands, comprising channels two through six, the antenna portion 1 supported by mast 2 is connected by means of the switching and matching components in 3 at or near terminals 4a and 4b, to transmission line 5 which is in turn connected to a television receiver. Antenna element 1 functions at these frequencies as a top-loaded dipole composed of half dipoles 7 and 9. 7 and 9 are straight metal members, usually tubing, oriented approximately parallel to the earth's surface to receive horizontally polarized electromagnetic waves. Half dipole 7 is top-loaded by conductive connection of members 11 and 15, and half dipole 9 is top-loaded similarly by 13 and 17. Although top-loading members do not radiate appreciably in this frequency band, 11, 15, 13, 17, greatly increase the radiation and reception from 7 and 9 and increase the radiation resistance at terminals 4a and 4b. The lengths of 7 and 9 can each be 10.25 inches and their diameters or cross-sections about ⅝ inches which dimensions are given as typical although the antenna system is by no means limited to these dimensions or those to be given in the further description of this invention. Member 11 can be a metal tube 5 inches long of diameter ⅝ inches, bent more or less 90° upward or downward at the end of 7 remote from terminals 4a–4b. Portion 15 is conductively connected at or near its mid point to the end of 11 remote from the bend at the end of 7.

Portion 15 can be in the shape of a rectangle and lie in a plane containing 11, and more or less at a right angle with 7. Portion 15 has a conducting surface and can be constructed of a metal tube ⅝ inch in diameter. Member 15 is bent to make the antenna more compact into segments 15a, 15b, 15c, and 15d. For symmetry needed to prevent reception of cross polarization and to maintain desired radiation patterns on all frequencies, 15a equals approximately 15b, and 15d equals approximately 15c. Segment 15a can be longer — but only slightly shorter — than 15d. Likewise, 15b is usually longer than 15c. However, in addition to these proportions, the tip-to-tip length of 15, starting at the unattached end of 15d and measuring along the bent or curved form of 15 to the unattached end of 15c, must be maintained and this tip-to-tip length can be, in the example described, 25.9 inches. The shape of 15 can be that of a half loop or semicircle of metal tubing with middle part connected at the end of 11 as is the rectangular member 15 shown in FIG. 1. Again, the arc length measured from tip to tip of the half loop must be about 25.9 inches or another value depending on the frequency band of interest and other considerations.

Similarly, portions 13 and 17 are conductively connected to 9. Portion 13 can be a tubing 5 inches long and ⅝ inch in diameter bent more or less 90° to 9 as shown. Element 17, whose mid region is attached conductively at or near the free end of 13, has the same shape and relative proportions as 15. The tip-to-tip length of 17 is somewhat longer than for 15, and for the example given can be 34.4 inches long, and constructed of ⅝ inch diameter tubing. The segments 17a, 17b, 17c, and 17d, for the rectangular portion 17, have the symmetry as for 15a, 15b, 15c, and 15d, and lie approximately in a plane parallel to 15 and containing 13. For example, 17a, 17b, 17c, and 17d, could all be of equal length of 8.6 inches, or 17a and 17d can be shaped to form a quarter circle with 17b and 17c also bent to form a similar quarter circle such that the tip-to-tip arc length of the semicircle so formed is 34.4 inches. Note that when portions 15c and 15d along with 17c and 17d are bent downward as shown in FIG. 1, the top-loading members of antenna 1, have the shape of an inverted letter W. When these same members are bent upward the top-loading structure has the form of the letter Y. These capital letters also aptly describe the form of the top-loading portions for the antenna functioning in the VHF TV band when portions 15 and 17 are formed into semicircular arcs or half loops.

The half dipoles 7 and 9 with top-loading portions 11, 15, 13, and 17 are separated and insulated at terminals 4a–4b and connected by a short section of transmission line 18 to terminal 20 of 3, the switching and matching portions to be described later. For the example described in application to television reception, 3 is controlled by the knob and indicator 10 so that channels 2, 3, 4, 5, and 6, when selected by the operator of the TV set are connected to terminals 4a–4b and matched to the twin line 5 by circuits within 3.

Referring again to FIG. 1, portions 15, 17 and 19 form the radiating elements of a directive array for the upper TV VHF frequencies between 174 and 216 MHz in the application of this invention to television reception. Member 19 functions as the driven element, member 15 now functions as the director element and member 17 as the reflector element for TV channels 7 through 13. The driven element 19 is connected by its portions 23a and 23b to twin lead transmission line 21 to terminal 22 of 3. When channels 7 through 13 are selected by the operator using knob 10 transmission line 21 is connected directly to transmission line 5. Although 15 and 17 have already been described as top-loading portions of dipole 7–9, the element lengths and interelement spacings are determined primarily by dimensions required for the broadband performance of these members as parasitic element in a directive antenna array operating in the upper TV VHF frequency range.

Driven element 19 is constructed with the same geometric shape as 15 and 17 previously described. The segments of ⅜ inch diameter metal tubing 19a, 19b, 19c, and 19d, are bent or curved with the same proportions and symmetry as those of 15 and 17 and form a continuous conducting element supported at or near the middle of 19 by a dielectric or plastic mast 25 which can be ½ inch in diameter and 5 inches long. Again, the length of 19a is almost equal to 19b for the rectangular form of 19. Likewise, segments 19a and 19b are usually longer than 19c or 19d. Because 19 must be oriented parallel to 15 and 17 with the same symmetry, it will be shaped as a rectangle or semicircle turned upward or downward as 15 and 17. However, its total tip-to-tip length must be maintained and in the example here illustrated, can be 30.25 inches. The matching of the driven element 19 to the transmission line 21 can be accomplished by means of wires or tubes 23a, 23b, 23c, and 23d, which can be 0.15 inches in diameter and everywhere parallel to and separated by a distance of 0.75 inches from portions 19a, 19b, 19c, and 19d. Members 23c and 23d are conductively connected to the two tips of 19 at the free ends of 19c and 19d. A small gap separates the ends of 23a and 23b which gap is formed by the diameter of dielectric mast 25 on to which ends of 23a and 23b are attached together with transmission line 21. The spacing 27 between 15 and 19 can be 8.3 inches and the separation distance 29 between 19 and 17 can be 12.1 inches.

For the example given, portions 31, 33, and 35 comprise another directive antenna array functioning in the UHF TV bands between 470 and 890 MHz. The metal wires or tubes used to construct 31, 33, and 35 can be 0.25 inches in diameter. The shape of these elements can be half loops or semicircles. A rectangular shape as shown for 15, 17, and 19 can also be used provided the symmetries and tip-to-tip lengths to be mentioned for the half loops are maintained. Elements 31, 33, 35, are all parallel to each other and can be bent upward as shown in FIG. 1, or downward. The driven element 35 is composed of three driven half loops in order to receive and match the entire frequency band from 470 to 890 MHz. These three half loops of 35 are separated by gap 39 which can be ¾ inches wide forming quarter circle segments 36a, 36b; 38a, 38b; and 40a, 40b. Segments 36a and 36b are of approximately equal lengths which can be 3.3 inches. 38a and 38b are of approximately equal lengths which can be 4.4 inches, and 40a and 40b are of approximately equal lengths which can be 6.1 inches. Members 36a, 38a, and 40a, are connected by wire 43a and members 36b, 38b, and 40b are connected by 43b. Wires 43a and 43b are connected to transmission line 41 to the UHF terminal of the television set. Half loops 36, 38, and 40 form concentric semicircles. They are positioned and attached to the wires 43a and 43b so that their free tip ends lie approximately on a straight line parallel to 19a and 19b. Driven element 35 made up of 36, 38, 40, and 43, forms a broadband radiator and when functioning with parasitic director and reflector 31 and 33 respectively, produce a directive radiation pattern toward arrow A or toward arrow B. Element 33 which can have a tip-to-tip length of 9.6 inches is parallel to, and of the same shape and symmetry as, 36, 38, 40, forming 35. It can be made from continuous wire bent in a semicircular arc conductively attached to 9 at or near the mid point of 33. The effect of 33 on 9 and the lower VHF performance is very small causing only a slight electrical lengthening of the half dipole 9. Element 33 functions as a parasitic reflector in the higher portion of the TV UHF band, and as a parasitic director in the lower portion of this band. The spacing between elements 40 and 33 can be 3.3 inches. Although a means for impedance matching is not shown where twin line 41 attaches to ends of 43a and 43b, such matching, if required, can be provided by a transformer, delta matching or other techniques known in the antenna art. Transmission line 41 can be connected to line 5 through 3 when line 5 is connected to both the UHF and VHF terminals of the TV receiver. Generally, all transmission lines are of the balance 300 ohm type. Shielded 300 transmission lines are preferred to prevent reception of signals by the unshielded line. Such signals received by unshielded transmission lines can cause ghosts and destroy front to back pattern performance of the antenna.

In FIG. 1 is also shown means for supporting and rotating the antenna. Insulating mast 2 which can be ¾ inch in diameter is attached to the base 8 and to dipole element 1 and to the UHF driven element 35 by wires or strips 43a and 43b. Mast 2 can be of plastic 8 inches long. It can be formed as a cross of dielectric material at terminal 4a and 4b such that dielectric or plastic rods are inserted snugly into the interior of metal tubes 7 and 9 to mechanically support 7 and 9 and their attachments. Also, rod 2 is inserted into base 8 such that the rod and antenna may be rotated nearly 360°. A pointer 6 is attached to the rod and indicates angular positions previously recorded where the best reception for a given station was received. Control box 3 with knob and indicator 10 can be mounted on rod 2 and serves to select the television channel rotation on linear motion of knob and dial 10. Attached to 3 are the circuit elements needed for impedance matching of lower VHF TV channels and the 300 ohm twin lines from elements 1 and 19 and the VHF 300 ohm twin line from the television receiver.

Those skilled in the antenna art will recognize that additional parasitic elements can be added in line with, and parallel to, 31, 35, and 33, to form a very high gain parasitic array antenna. These additional parasitic elements can be attached directly to the VHF dipole elements 7 and 9 with the beneficial effect of slightly increasing the effective diameter of 7 and 9 and increasing the impedance bandwidth. However, it is also possible to construct the UHF array rotated 90° with respect to the line formed by VHF elements 7 and 9. The parasitic elements can be supported then by metal or plastic rods attached to or near the mid points of the parasitic elements. In this 90° rotated configuration there can be even less interaction between the UHF and VHF antenna patterns than with the antenna portions positioned as illustrated in FIG. 1.

Figure 2:
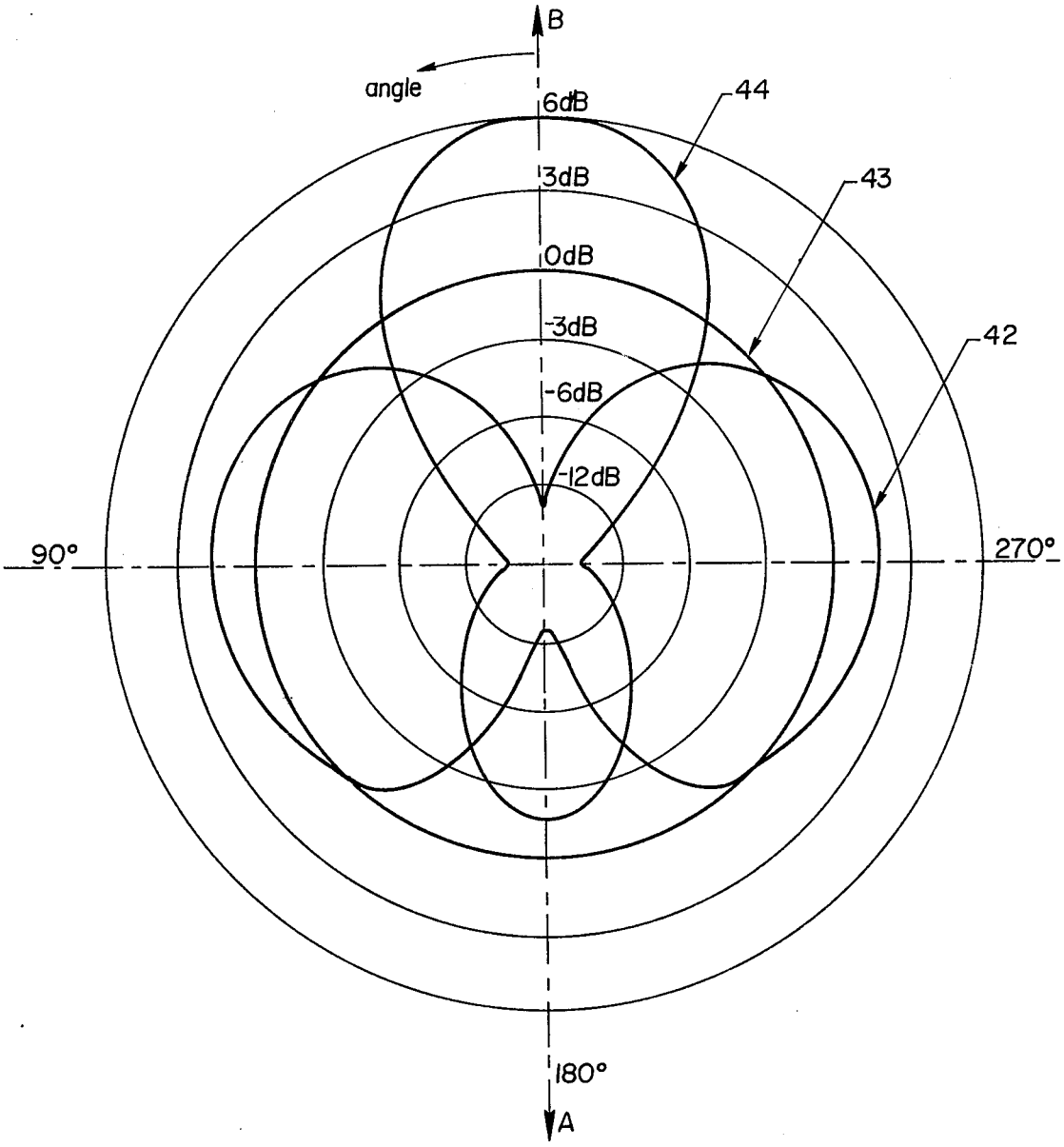
FIG. 2 is a typical horizontal radiation pattern for the upper and lower VHF television bands.

Typical radiation patterns for azimuthal angles and horizontal polarization in the VHF TV band are shown in FIG. 2. The matched top-loaded dipole 1 operating on the lower portion of the VHF frequency band channels 2 through 6 produces a pattern similar to the angle vs dB diagram 42. Deep pattern nulls are obtained in a direction indicated by arrows A and B of FIGS. 1 and 2. A reference isotropic or zero dB gain level 43 is indicated by a darker circle. The sharp nulls can be rotated toward directions of unwanted reflected signals to reduce ghost effects. Due to low loss matching and top-loading gains are nearly that of a full size dipole antenna. For the upper VHF and the pattern marked 44 in FIG. 2 is typical. The maximum, approximately 6 dB above isotropic reference, will be in the direction of arrow B in FIGS. 1 and 2. This desirable performance is due to the optimization of the directive array elements 15, 19, and 17, and the matching to the 300 ohm twin line 21.

Figure 3:
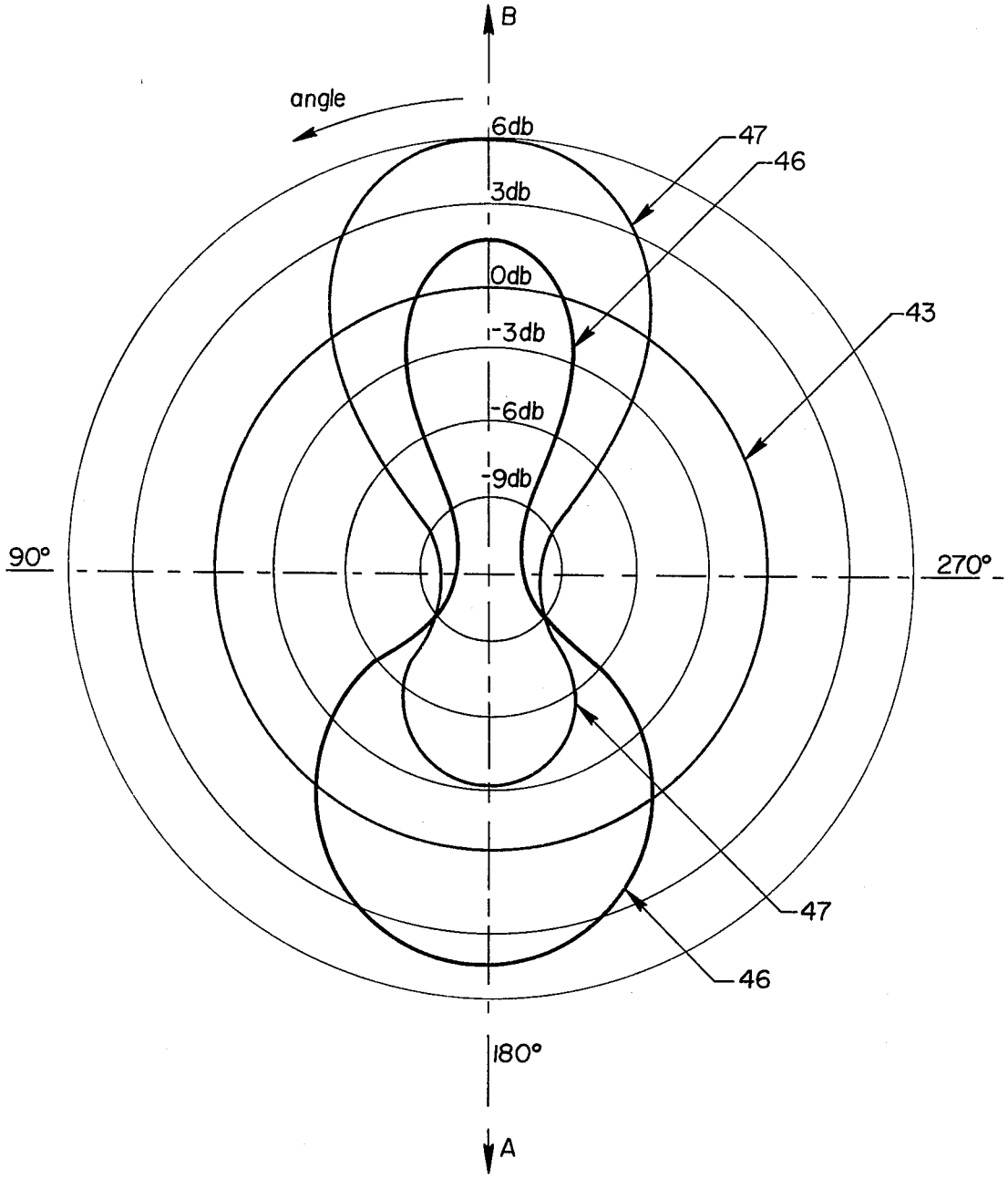
FIG. 3 is a typical horizontal radiation pattern for the upper and lower UHF television bands.

In FIG. 3 is shown also a horizontal angle diagram with typical radiation patterns in the UHF TV band. In the lower frequency portion of the UHF band a pattern marked 46 on FIG. 3 is typical due to the element 33 here functioning as a director. In the upper frequency portion of the UHF band both elements 31 and 33 are effective as parasitic directors and reflectors respectively producing a typical pattern as marked 47 on FIG. 3. 43 indicates isotropic radiation pattern as a reference gain level.

Figure 4:
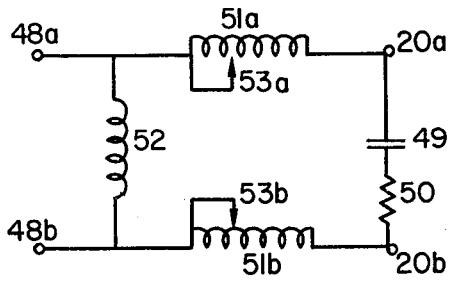
FIG. 4 is a schematic diagram of the matching circuit for the lower portion of the VHF television band; and, FIG. 5 is a diagram of a typical switch and channel selector with attached components for the VHF television band.

FIG. 4 is a schematic diagram of the circuit used to transform the antenna impedance of the dipole 1 as presented at terminal 4a, 4b which corresponds to circuit points 20a, 20b, of FIG. 4, to 300 ohms of the twin line 5 which is attached to points 48a, 48b of FIG. 4. The reactance of a dipole antenna of less than one half wave length is known to be capacitive as indicated in FIG. 4 by capacitor 49 with this capacitive reactance increasing with decreasing frequency. The radiation resistance, $R_a$, indicated by 50 is known to increase as frequency is increased for electrical short antennas. The network selected makes effective use of these characteristics by use of a circuit wherein a shunt coil, labelled 52 in FIG. 4, has a value which corresponds by formula (1) to values $R_a$ and $R_c$, wherein $R_c$ is a resistance of 300 ohms to 300 ohm twin line 5 across 48a and 48b. This invention makes use of the compensating growth of the reactive impedance $\omega L_3 = 2\pi f L_3$, where $\pi = 3.1416$ and f is the frequency of the received signal which value, $\omega L_3$, grows with that of $R_a$, 50, as frequency increases, to effect antenna matching to the line without changing $L_3$. Likewise, $\omega L_2/2$, the inductive reactances of 51a and 51b, can be subtracted from the negative capacitive reactance due to $C_a$ labelled 49 in FIG. 4, of the antenna in a manner given by formula (2) such that small coils, $L_2/2$, 51a and 51b which are decreased by shorting connections 53a and 53b can be used to complete the components required for matching to 300 ohm line 5 attached at 48a, 48b, for each of the lower VHF TV channels 2, 3, 4, 5, and 6. The values of $L_3$, $R_a$ and $R_c$ needed to transform the impedance of the antenna to that of the transmission line are given by the algebraic relationship:

$$\omega L_3 = \frac{R_a R_c}{\sqrt{R_a(R_c - R_a)}} \qquad \text{(Formula 1)}$$

and the values $L_2 = 2\ L_2/2$ are given by the relationship:

$$\frac{1}{\omega C} + \omega L_2 = -\sqrt{R_a(R_c - R_a)} \qquad \text{(Formula 2)}$$

The usual method of antenna matching of dipoles less than one half wavelength long uses coils 51a and 51b to completely cancel the capacitive reactance of 49 leaving the radiation resistance $R_a$, 50, as the impedance connected to the transmission line terminals 48a, 48b. The method employed here does not use as large coils because all the capacity indicated by 49 need not be completely cancelled with inductive reactances 51a and 51b. Such smaller coils are less lossy and less expensive to build. The values of coils 51a and 51b each can be 0.25 microhenrys on Channel 2, 54–60 mHz, and reduced to zero on Channel 6, 82–88 mHz, by moving connections 53a and 53b.

The coil inductance 52 is of fixed value which can be 0.22 microhenries in the example illustrated. It serves to transform the impedance of the antenna at 20a, 20b, and the impedance of selected portions of coil 51a and 51b to 300 ohms. The important advantage of the circuit is, that with the addition of coil 52, an impedance approximately 300 ohm is attained which reduces the mismatch or reflection losses and hence improves the reception of television signals.

Figure 5:
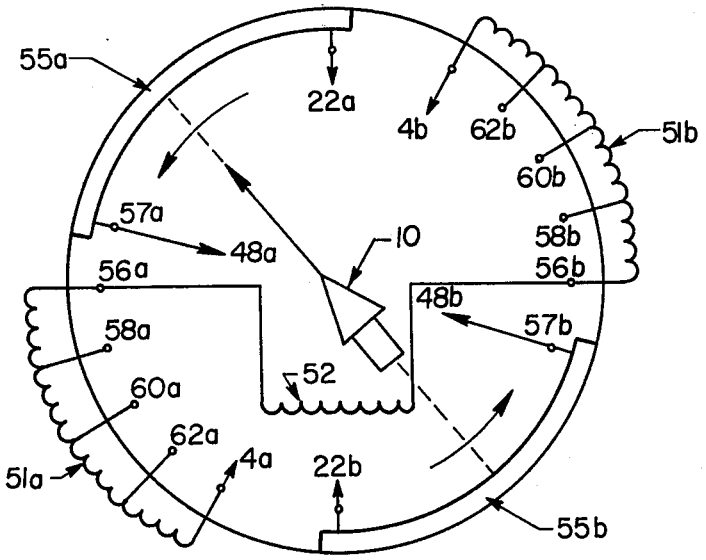

In FIG. 5 is illustrated one switching arrangement whereby the coils 51 and 52 can be conveniently introduced between terminal 4a–4b and the transmission line 5 for TV channels 2 through 6. This switch can also connects line 5 directly to line 21 which is attached to 23a and 23b of element 19, receiving the upper VHF TV band. The switch is indexed in 15° rotations and shows here six positions for different channels of interest to the television operator. However, 30° indexing switches are more conventional and cheaper so that the use of a two-sided switch each side with 12 or less contacts rather than 24 contacts as shown could be used for this function. It is understood also that a linear rather than rotating switch could connect the coils, terminals and lines effectively in a similar functional manner to that illustrated in FIG. 5. Coils should be sufficiently separated and oriented to prevent excessive inductive coupling among them. The use of continuous shorting contacts is not necessary although convenient.

A channel selection switch and matching network components are shown schematically in FIG. 5. By rotating the curved metal strips 55a, 55b attached to channel selector and pointer 10 across contacts 22 and 57, the transmission line 5 which is attached to 57a and 57b is connected to terminals 22a and 22b. Thus, the switch position, as shown in FIG. 5, is used for TV channels 7 through 13 to connect the directive array elements fed by 19 through transmission line 21 to transmission line 5 attached to the VHF terminals of the television receiver. Likewise, when moving strips 55a, 55b are advanced by turning knob 10 counter clockwise to bring 57a into contact with 56a and 57b into contact with 56b, then terminals 57a, 57b, which are in turn attached to terminals 48a, 48b, then all of coils 51a, 51b and coil 52 are connected as required for receiving channel 2. Continuing the counter clockwise motion of the switch, smaller incremental values of coils 51*a* and 51*b* are selected and connected in parallel with coil 52 for impedance matching of TV channels 3, 4, 5, and 6.

Those skilled in the art will recognize, or be able to ascertain using no more than routine experimentation, many equivalents to the specific elements described herein. Such equivalents are intended to be covered by the following claims.

What is claimed is:

1. A shortened multiband antenna comprising: a support mast, a horizontally polarized electrically center fed first dipole supported on said mast, and first and second end loading elements in the approximate shape of an inverted W symmetrically connected to opposite ends of said dipole in parallel planes orthogonal thereto.

2. An antenna as claimed in claim 1 including an inverted U-shaped second dipole supported on said first dipole at a location between and parallel to said first and second end loading elements, said second dipole dimensioned to operate in a second frequency band in association with said first end loading element acting as a director and said second end loading element acting as a reflector.

3. An antenna as claimed in claim 2 including a third dipole antenna operable in a third frequency band, said third dipole antenna comprising three coplanar and concentric half loops situated between said second dipole and said second end loading element.

4. An antenna as claimed in claim 3 including a switching and matching network connecting said three driven elements to a receiver, including indicators for frequency band selection and antenna orientation.

* * * * *